United States Patent [19]

French

[11] 4,123,086

[45] Oct. 31, 1978

[54] CONTINUOUS STATIONERY ASSEMBLIES

[75] Inventor: Denis E. E. French, London, England

[73] Assignee: Moore Business Forms, Inc., Niagara Falls, N.Y.

[21] Appl. No.: 817,861

[22] Filed: Jul. 21, 1977

[30] Foreign Application Priority Data

Jul. 21, 1976 [GB] United Kingdom ..... 30406/76

[51] Int. Cl.[2] ..... B41L 1/20

[52] U.S. Cl. ..... 282/11.5 A; 282/21 R

[58] Field of Search ..... 282/7, 11.5 A, 21 R, 282/21 D, 1 A; 229/69

[56] References Cited

U.S. PATENT DOCUMENTS

| | | | |
|---|---|---|---|
| 2,178,103 | 10/1939 | Johnson | 282/11.5 A |
| 3,305,247 | 2/1967 | Fulk | 282/11.5 A |
| 4,032,065 | 6/1977 | Heimann | 282/11.5 A X |

*Primary Examiner*—Frank T. Yost

*Attorney, Agent, or Firm*—Watson, Cole, Grindle & Watson

[57] ABSTRACT

A series-connected business form adapted to be fed through the printing means of a business machine includes a continuous locating web folded along opposite margins to define longitudinal flaps which are secured to the underlying web, feed holes in the flaps and in the underlying web arranged to engage a feed means of the business machine, transverse perforations in the web and flaps for separating the form into individual units, individual sheets associated with the units having first opposed edges underlying the flaps and second opposed edges lying adjacent the lines of perforations, and glue spots along the transverse lines adjacent the second edges for immobilizing the sheets against longitudinal shifting. Therefore, upon the printing of a number of the units, the next-to-the-last of such units so printed may be separated along one of the transverse perforation lines where after one of the sheets associated with the last of the units may be separated from the web to thereby leave the web of such last unit available as a drive web for initiating the feed of the remaining units to be printed through the printing means.

In lieu of sheets, another web or webs may overlie the locating web with opposed edges of these other webs underlying the flaps. All the webs have transverse lines of weakening to facilitate separation of the form into individual units.

7 Claims, 4 Drawing Figures

CONTINUOUS STATIONERY ASSEMBLIES

Many kinds of continuous stationery assemblies have been proposed for feeding to a printing unit of a computer or mini-computer. These assemblies have included plain paper webs, perhaps bearing blocks of transverse lines spaced apart by a distance of 1/6th inch.

These assemblies are made up into packs with the individual webs interleaved with one-time carbon paper. Alternatively the assemblies may comprise a plurality of webs of self-manifolding paper. More sophisticated assemblies of continuous stationery have also been used and these include, for example, continuous manifolding form assemblies as described in British Pat. Nos. 919,496 and 1,376,447. All these assemblies include marginal feed apertures.

Such assemblies are sometimes used with office mini-computers or terminal printers for relatively short runs. When the assemblies are positioned in the print unit the marginal feed apertures at opposite side edges of the continuous stationery assembly are engaged on the feed pins of a pair of feed pin tractors at the outfeed side of the print unit. When it is required to feed the stationery the tractors are driven and the stationery is fed. The tractors have of necessity to be positioned several inches above the printing position so that each time the continuous stationery assembly is reloaded into the print unit one set (one form length) at the leading end of the assembly is lost.

Although this constitutes a loss each time a fresh pack of forms is loaded into the print unit greater losses are incurred when it is necessary to print a few form lengths at a time and especially if only a single form length is printed because at each printing a partly used pack is loaded into the print unit and this entails losing one form length at each reloading.

In the manufacture of certain continuous stationery assemblies, in order to secure the webs of the assembly together the webs are joined by adhesive before being folded into packs. When the webs of these packs are moved into a straight line position as when being passed through a print unit the webs tend to become distorted in the areas adjacent the cross perforations between the form lengths of the assembly. This is commonly referred to as tenting and creates difficulties in the feeding of the assemblies as through a print unit.

In copending U.S. application, Ser. No. 727,518, commonly owned herewith, a continuous form assembly is described as comprising a plurality of continuous stationery webs with the last web and at least one other web containing lines of marginal feed apertures, the said webs being joined together adjacent their margins wherein the webs intermediate the first and last webs have a width less than the width of the first and last webs and the said intermediate webs are joined together, and the first web of the assembly having a line of longitudinal perforations substantially in line with the edges of the intermediate webs so that the intermediate webs can be detached from the last web.

It is an object of the present invention to provide an improved stationery assembly embodying a locating web.

It is another object of the present invention to provide an improved stationery assembly which is capable of being fed to a print unit without the necessity for losing the leading form length newly inserted into the assembly at each reloading of the print unit.

It is a further object of the present invention to provide a construction of a continuous stationery assembly which does not suffer from the defect of "tenting".

According to the present invention a continuous stationery assembly comprises a plurality of plies including at least one record web and a continuous locating web having a turned over flap at each longitudinal marginal edge, and marginal longitudinal feed apertures in the turned over flap, and a longitudinal line of adhesive securing the turned over flap to the body of the locating web to locate the record web between the turned over flaps and the body of the locating web at opposite sides of the assembly.

Preferably more than one record web is included with transfer material between the record webs and between the last record web and the locating web.

Continuous stationery assemblies in accordance with the present invention will now be described by way of example with reference to the accompanying drawings wherein.

Figure 1:
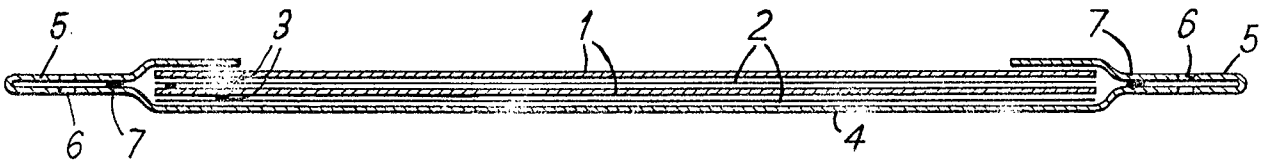
FIG. 1 is a sectional view of one embodiment of the present invention, taken substantially along line 1—1 of FIG. 2.
Figure 2:
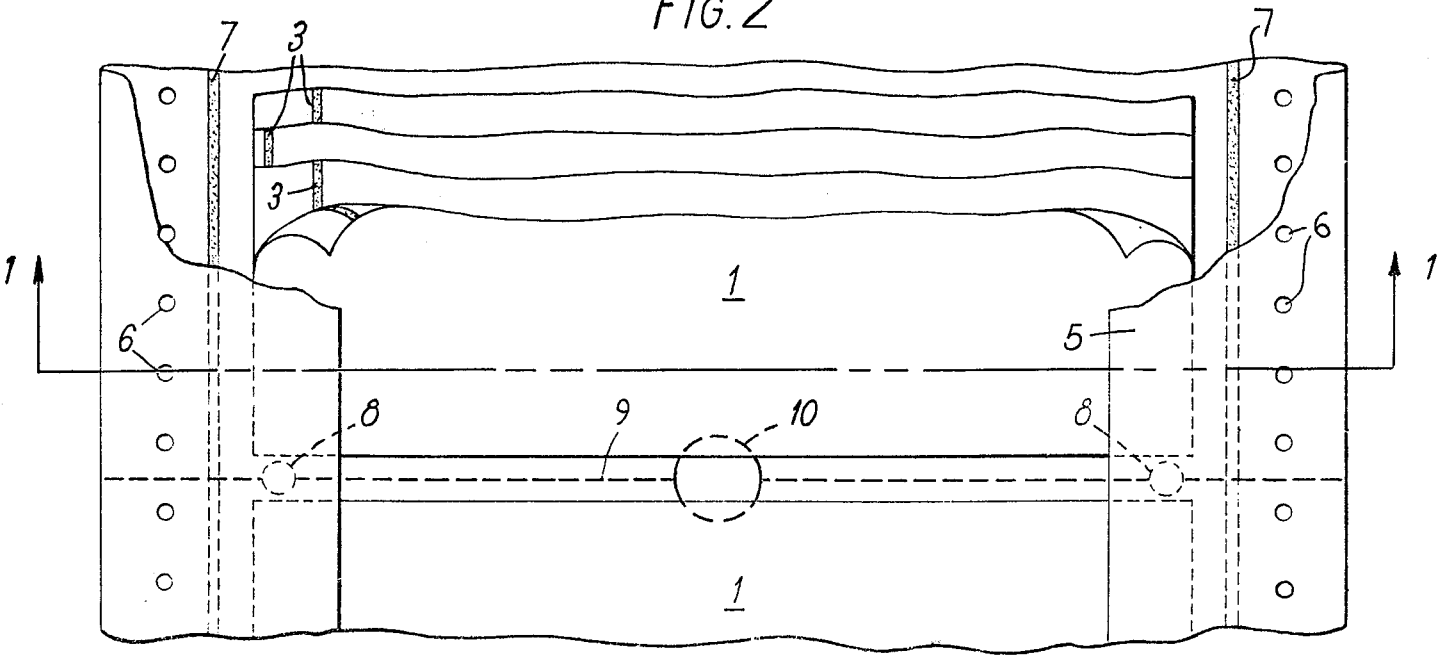
FIG. 2 is a plan view, partly broken away, of a portion of the one embodiment of the present invention.

Referring to FIGS. 1 and 2 of the drawings, there is shown an assembly comprising a plurality of individual record sheets 1 (as shown, two record webs) with each record sheet 1 having an underlying separate sheet of carbon paper transfer paper 2. The sheets are joined to each other by longitudinal lines of adhesive 3 which are located at the left hand side thereof and which constitute a stub portion.

A continuous locating web 4 constitutes a record web beneath second transfer sheet 2 and this locating web is wider than the record sheet. Each outer side edge of locating web 4 is folded over to form a flap 5. This folded over flap has lines of marginal feed apertures 6 formed in it adjacent the outer edges of the assembly, and the folded over flap part is secured to the body part of locating web 4 by a line of adhesive 7 within the lines of apertures 6 shown diagrammatically in FIG. 1.

The outer end of each flap extending inwardly of the assembly beyond the line of adhesive 7 extends above the outer side edge of sheets 1 and 2, and these outer ends of flap 5 locate sheets 1 and 2 in position transversely of the assembly between the flaps and the body of the locating web 4. Sheets 1 and 2 and web 4 are thereby enabled to be fed through the print unit.

Each sheet 1 and 2 have a depth of one form length, and spots of adhesive 8 are secured between adjacent form lengths adjacent each side edge of the assembly between the respective flaps 5 and locating web 4 to locate the sheets in position longitudinally on locating web 4. Locating web 4 is divided into form lengths by lines of tear off perforations 9.

Figure 3:
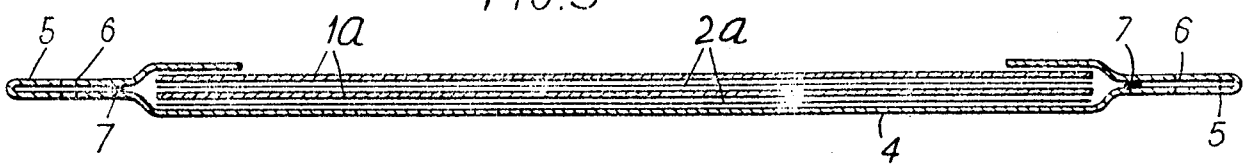
FIG. 3 is a sectional view of another embodiment of the invention, taken substantially along line 3—3 of FIG. 4.
Figure 4:
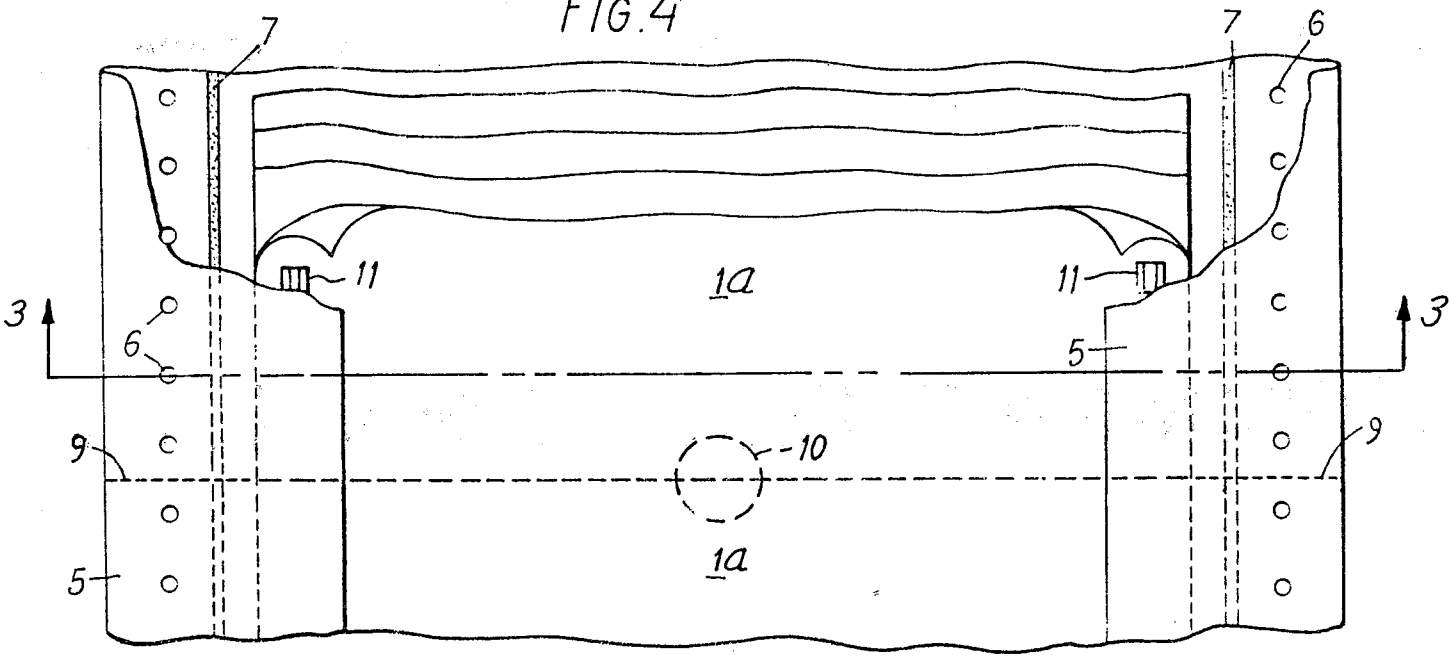
FIG. 4 is a plan view, partly broken away, of a portion of the another embodiment of the invention.

Referring to the stationery assembly shown in FIGS. 3 and 4, this is similar to the assembly shown in FIGS. 1 and 2 except that record webs and transfer webs 1*a* and 2*a* are each a continuous stationery web rather than being of separate form lengths.

As shown, the individual webs, instead of being secured by lines of adhesive as shown at 3 in FIGS. 1 and 2, are secured together by paper staples illustrated diagrammatically at 11 such paper staples being disclosed for example in the aforementioned British Pat. No. 1,376,447. The continuous webs are separated into form lengths by lines of transverse perforations 9.

Because the webs are in continuous form there is no need to employ spots of adhesive between adjacent form lengths for location purposes. When it is required to remove a form length it is detached by tearing across the line of transverse tear off perforations 9.

In both the embodiments described an aperture 10 is formed in locating web 4 adjacent each transverse tear-off perforation to enable the insert record webs to be detached from the locating web by the insertion of a finger through the aperture to dislodge the insert web from the locating web.

Although the invention has been described with reference to record sheets webs and transfer webs, it will be apparent that the assembly may comprise webs of self-manifolding paper which renders unnecessary the provision of transfer sheets and webs. Also the invention may comprise a backing locating web 4 with a continuous web or individual sheets of letter headed paper, located between the side flaps 5 of the locating web.

I claim:

1. A series-connected business form adapted to be fed through the printing means of a business machine, comprising a continuous locating web folded inwardly along marginal edges thereof to define longitudinal flaps having edges spaced transversely of one another, said flaps overlying said web, at least one of said flaps and said web underlying same each having feed holes extending longitudinally thereof in superimposed relationship and being arranged to engage the feed means of the business machine so that the business form is thereby advanced into and past the printing means, said flaps being attached to said web by first and second securement means respectively spaced outwardly of said flap edges, said web and said flaps having spaced transverse lines of perforations for separating the form therealong into individual units, individual sheets respectively associated with said units and overlying said web, each said sheet having first opposed marginal edges lying inwardly of said first and second securement means and having second opposed marginal edges respectively spaced inwardly of said transverse lines of perforations, means on said locating web lying adjacent said second opposed edges for immobilizing said sheets against shifting longitudinally of said web, and portions of said flaps overlapping said first marginal edges of said plies, whereby upon the printing of a number of said units, the next to the last of said units so printed may be separated along one of said transverse lines of perforations whereafter one of said sheets associated with the last of said units may be separated from said web to thereby leave said web of said last unit available as a drive web for initiating the feed of the remaining units to be printed through the printing means.

2. The business form according to claim 1, wherein said immobilizing means comprise spots of adhesive securing said flaps and said web together.

3. The business form according to claim 1, wherein both of said flaps and said web underlying same each have rows of superimposed feed holes therein for engaging the feed means of the business machine.

4. The business form according to claim 1, wherein said web has apertures therein on said transverse lines of perforations, and said second marginal edges overlie said apertures to thereby facilitate grasping of said sheets at said second edges upon separating said sheets from said web.

5. A series-connected business form adapted to be fed through the printing means of a business machine, comprising a continuous locating web folding inwardly along marginal edges thereof to define longitudinal flaps spaced transversely of one another, said flaps overlying said web, at least one of said flaps and said web underlying same each having feed holes extending longitudinally thereof in superimposed relationship and being arranged to engage the feed means of the business machine so that the business form is thereby advanced into and past the printing means, said flaps being attached to said web by first and second securement means respectively spaced outwardly of edges of said flaps, another continuous web superimposed over said outer web, said webs including said flaps having spaced transverse lines of weakening in superimposed relationship for separating the form therealong into individual units, and portions of said flaps overlapping opposed sides of said another web, whereby upon the printing of a number of said units, the next to the last of said units so printed may be separated along said transverse lines whereafter said another web of the last of said units may be separated from said locating web thereof to thereby leave said outer web of said last unit available as a drive web for initiating the feed of the remaining units to be printed through the printing means.

6. The business form according to claim 5, wherein both of said flaps and said locating web underlying same each have rows of superimposed feed holes therein for engaging the feed means of the business machine.

7. The business form according to claim 5, wherein said locating web has apertures therein on said transverse lines of weakening to thereby facilitate grasping said another web, after the form is separated along said transverse lines, upon separating said another web from said locating web.

* * * * *